US005402994A

United States Patent [19]

Egger

[11] Patent Number: 5,402,994

[45] Date of Patent: Apr. 4, 1995

[54] DEVICE FOR HEAT-TREATING METAL WORKPIECES

[75] Inventor: Helmut Egger, Korntal, Germany

[73] Assignee: Aichelin GmbH, Germany

[21] Appl. No.: 275,786

[22] Filed: Jul. 15, 1994

[51] Int. Cl.[6] ..... C21D 9/00; C21D 1/74

[52] U.S. Cl. ..... 266/252; 266/96; 266/262

[58] Field of Search ..... 266/96, 252, 262

[56] References Cited

U.S. PATENT DOCUMENTS

| | | | |
|---|---|---|---|
| 4,238,122 | 12/1980 | Snyder | 266/252 |
| 4,415,145 | 11/1983 | Herdieckerhoff | 266/262 |
| 4,480,822 | 11/1984 | Mauratelli | 266/252 |
| 5,164,145 | 11/1992 | Smith | 266/262 |
| 5,190,718 | 3/1993 | Buffard | 266/262 |
| 5,265,851 | 11/1993 | Beuret | 266/262 |
| 5,286,007 | 2/1994 | Takagi | 266/252 |

FOREIGN PATENT DOCUMENTS

| | | |
|---|---|---|
| 0023546 | 6/1980 | European Pat. Off. . |
| 0209408 | 6/1986 | European Pat. Off. . |
| 0296102 | 6/1988 | European Pat. Off. . |
| 95877 | 9/1968 | France . |

*Primary Examiner*—Peter D. Rosenberg
*Attorney, Agent, or Firm*—Kokjer, Kircher, Bowman & Johnson

[57] ABSTRACT

An apparatus for heat-treating metallic workpieces, which includes two successive furnaces, a feeding device for feeding workpieces to the first furnace, and conveyor means from transporting workpieces from the first to the second furnace. Both furnaces are equipped with gas-tight inlet and out doors. The conveyor means are also gas-tight. The furnaces are each equipped with means for controlling temperature, dwell time and atmosphere.

10 Claims, 3 Drawing Sheets

DEVICE FOR HEAT-TREATING METAL WORKPIECES

The present invention relates to a device for heat-treating metal workpieces having a feeding device for feeding workpieces in cycle-controlled manner to at least one furnace unit for the purpose of carrying out a first heat-treatment step, the one furnace unit being connectable to at least one downstream furnace unit for carrying out at least one further heat-treatment step.

Industrial heat-treating systems are operated, to the extent possible, either continuously or in a cycle-controlled manner, for the purpose of achieving the highest possible throughput. In addition to continuously operating conveyer furnaces, cycle-controlled pusher furnaces have become known, which are used especially in connection with pusher-type gas carburizing plants. Conventional pusher-type systems are in most of the cases arranged in a rectangular pattern so as to provide a closed circuit.

Plants of this kind are designed for high throughput, but are connected with the disadvantage that due to the cycle-controlled continuous operation, adaptation measures have to be carried out when the operation is to be changed over from one type of charge to another. In some of the cases, for example, empty grates have to be run through the furnace, or the furnace plant has to be run empty before any parts of a different nature can be processed.

In addition, two-track and three-track pusher plants have been developed in order to permit a cycle-controlled operation with different cycle times. A multi-track design leads, however, to reduced uniformity of the heat-treatment.

Further, pusher systems present the fundamental disadvantage that a certain minimum utilization is required for their economic operation because in the case of less than full utilization empty grates must be run through the furnace.

In order to permit greater flexibility of the heat-treatment, especially with smaller throughput rates, rotary furnaces were combined with upstream and downstream pusher-type and/or conveyor furnaces. While carburizing is mostly effected in the area of the single-stage or double-stage rotary furnace, the heating-up and diffusion processes are mostly run in the pusher furnaces and/or conveyor furnaces.

A furnace system of this type has been known from DE 34 41 338 A1. In the case of this furnace, the workpieces are heated up in a pusher-type furnace, in a protective-gas atmosphere, and are then transferred via an intermediate door into a connected carburizing chamber designed as cycle-controlled rotary furnace. At the end of different, cycle-controlled carburizing times, the different charges can be transferred via an intermediate door into the diffusion chamber, which latter is also designed as a cycle-controlled rotary furnace. From the diffusion chamber, the charges are transferred through an intermediate door into a compensation chamber designed as pusher-type furnace.

A plant of this kind enables the carburizing time to be controlled differently for the individual charges so that different workpieces can be heat-treated, or different carburizing depths can be achieved.

However, with a plant of this type it is only possible to heat-treat all the charges present in one rotary furnace area with one and the same predetermined temperature and one and the same given atmosphere. And in some of the cases individual grate locations must remain empty in order to adhere to the predetermined treatment parameters for the other charges.

Now, it is the object of the present invention to provide a device for heat-treating metal workpieces which guarantees the highest possible flexibility.

According to the present invention, this object is achieved by the fact that in a device of the type described above at least the first furnace unit comprises a plurality of individual chambers each of which can be closed by gas-tight doors, that a workpiece charge can be directly fed, via the feeding device, into each individual chamber as desired, that the temperature, dwelling time and atmosphere can be individually controlled for each workpiece charge in each chamber, and that transfer means are provided for removing workpiece charges from one desired chamber after the respective desired dwelling time, and for feeding them into the next following furnace unit.

An essential advantage of this structure is seen in the fact that the heat-treatment parameters can be freely selected for each individual chamber and each individual charge which means that the temperature, dwelling time and atmosphere can be individually controlled for each individual charge. A furnace structure of this type can be used with particular advantage for flexible gas carburization of smaller charges to be heat-treated.

Due to the fact that the heat-treatment parameters, namely pressure, dwelling time and temperature, can be individually controlled for each individual charge, it is rendered possible to perform heat-treatments of high-quality parts with an especially high degree of precision. This possibility is further improved by the fact that a diffusion calculation can be carried out, based on real data, for each individual charge.

The fact that each individual chamber can be closed by gas-tight doors and that the temperature and dwelling time can be controlled individually provides the possibility to carry out different heat-treatment processes simultaneously in the individual chambers. Thus, it is for example possible to run gas-carburizing, carbonitriding, hardening and/or tempering, nitrocarburizing processes, etc., simultaneously in different individual chambers, during cycle-controlled operation of the system. This enables even smaller charges to be treated economically.

Given the fact that individual chambers can be put out of service separately, a high degree of economy is guaranteed also when the system is not utilized to full capacity. In addition, maintenance work can be carried out on certain individual chambers while the remaining individual chambers continue to operate.

Another advantage of the device according to the invention lies in the fact that no empty grates are required, which allows a particularly economic operation under heavily fluctuating utilization conditions, and which minimizes the system wear.

According to an advantageous further development of the invention, the feeding system comprises a gas-tight entry transfer lock, to which a protective gas is applied, and the transfer system comprises a gas-tight intermediate transfer lock to which a protective gas is applied.

It is thus possible for the charge transfer to be effected in a protective-gas atmosphere, preferably in an oxidation-free protective-gas atmosphere, from the starting point of each charge (cold charge at the beginning of the heat-treatment) to a discharge point of the charge at the end of a quenching unit or a cooling lock.

According to an advantageous further development of the invention, the feeding system comprises a vacuum entry lock, for loading the entry transfer lock.

This feature provides the advantage that the system can be charged with particularly short cycle times, a feature which has especially advantageous effects if different heat-treatment parameters are to be observed for different charges, for example for the purpose of achieving different carburizing depths.

According to a further development of the invention, the intermediate transfer lock is also equipped with a vacuum-type entry lock.

One thereby obtains the possibility to introduce into the system repair charges, that are to receive a special heat-treatment, or charges that are to be hardened only.

According to a further embodiment of the invention, the intermediate transfer lock and the entry transfer lock are each provided with a grate conveyor car with gas-tight drive.

This allows the grate to be transported largely free from wear under protective-gas conditions.

According to a convenient further development of the invention, the drive is designed as a controlled-position continuous drag-chain drive.

According to a preferred further development of the invention, the intermediate transfer lock is designed as cold transfer tunnel with inner insulation.

It is thereby rendered possible to do without any heating for the intermediate transfer lock, while the transfer is effected under protective-gas conditions.

According to an advantageous further development of the invention, each individual chamber is preceded by a cross-pusher means for loading and unloading.

This feature provides the possibility to move different charges in a simple way from the grate transport car into an individual chamber, or from an individual chamber onto another grate transport car or another downstream unit.

According to another embodiment of the invention, at least one downstream furnace unit comprises a plurality of individual chambers, each of which can be closed by gas-tight doors and can be individually controlled with respect to temperature, dwelling time and atmosphere.

This feature provides the advantage that it allows each charge to be subjected to an optimized intermediate and/or final heat-treatment, since the temperature, dwelling time and atmosphere can be freely selected in each case.

According to a convenient further development, there are provided for this purpose respective intermediate treatment chambers that can be connected with a downstream final treatment chamber via a gas-tight door.

The intermediate or final treatment chambers may be followed optionally by additional units, preferably a discharge lock with an oil, salt or polymer quenching bath, a single-item unloading device with hardening press and re-cooling system for hardening delicate workpieces, a high-pressure gas quenching unit or a gas-cooling lock.

In any case, the system can be extended by additional individual chambers, due to its modular design, while maintaining the remaining system components, such as quenching baths, transfer locks, or the like.

The entire plant can of course be supplemented by additional components, such as washing systems, annealing furnaces with cooling sections, or the like.

If a high-pressure gas quenching unit is connected with a final treatment chamber, then the cooling gas from the high-pressure quenching chamber can be used with advantage as protective gas for the intermediate transfer lock, the entry transfer lock and/or the vacuum entry lock.

It is apparent that the modular design of the furnace units, based on individual chambers for which the heat-treatment parameters temperature, dwelling time and atmosphere are freely selectable, enables a plurality of different plant configurations to be implemented.

It is understood that the features mentioned above and those yet to be explained below can be used not only in the respective combinations indicated, but also in other combinations or in isolation without leaving the context of the present intention.

An exemplary embodiment of the invention is depicted in the drawings and will be explained further in the description below.

BRIEF DESCRIPTION OF THE DRAWINGS

FIG. 1 shows a first embodiment of the invention indicated generally reference numeral 10.

Figure 1:
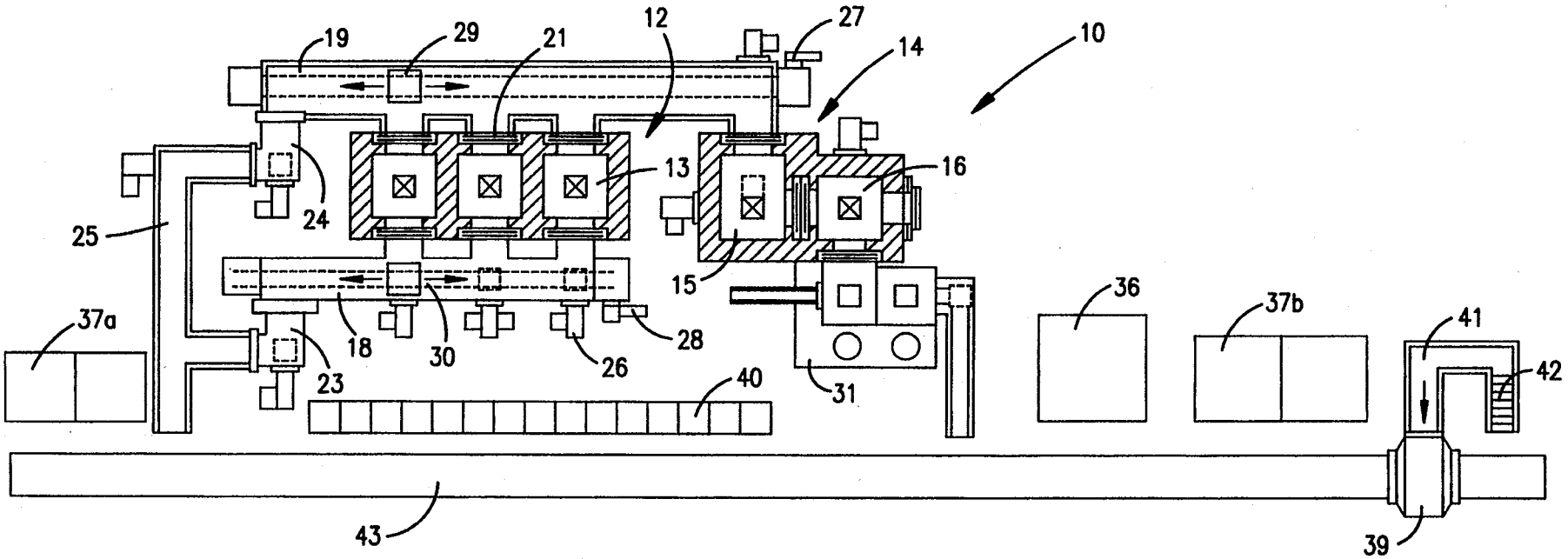
FIG. 1 shows a diagrammatic representation of a first embodiment of a device according to the invention.

A first furnace unit 12 is subdivided into three similar individual chambers, each of which can be closed by gas-tight inlet doors and outlet doors 21. An additional furnace unit 14 comprises an intermediate treatment chamber 15 with a gas-tight inlet door, that can be connected with a final treatment chamber 16 via a gas-tight connection door. The heat-treatment parameters temperature, dwelling time and gas atmosphere can be controlled individually for each individual chamber 13 of the first furnace unit 12, and also for the intermediate treatment chamber 15 and the final treatment chamber 17.

For charging the first furnace unit 12, an entry transfer lock 18 is provided into which individual grates with workpiece charges can be introduced via a vacuum entry lock 23. A grate transport car 30 can be moved inside the entry transfer lock 18 by means of a gas-tight continuous drag-chain drive 28. Driving is effected via a servomotor with positioning control which enables the grate transport car 30 to be positioned in front of the exit of the vacuum inlet lock 23 or in front of the entry of any of the individual chambers 13 of the furnace unit 12.

For pushing the grates out of the vacuum entry lock 23 and into the entry transfer lock 18, or for pushing them from the entry transfer lock 18 through an open inlet door into the individual chambers 13, and unloading them later from the individual chamber through an open outlet door, respective cross-pusher means 26 are provided.

The first furnace unit 12 and the intermediate treatment chamber 15 of the downstream furnace unit 14 are connected via an intermediate transfer lock 19. The intermediate transfer lock 19 is not heated and is provided with an inner insulation as protection against radiation. For transportation of the grates, another grate transport car 29 is provided that can be displaced and positioned inside the intermediate transfer lock 19 by means of a gas-tight grate transport car drive 27.

A protective gas is applied to both the entry transfer lock 18 and the intermediate transfer lock 19. Workpiece charges can be fed into each of the individual chambers 13 via the entry vacuum lock 23 and the entry transfer lock 18, and can be transferred in a protective-gas atmosphere, at the end of an individually controlled heat-treatment (temperature, dwelling time and atmosphere), by means of a grate transport car 29 via the intermediate transfer lock 19 to a position in front of the next following intermediate treatment chamber 15. From this position, the grate can be pushed by the cross-pusher means through the open inlet door into the intermediate treatment chamber 15. At the end of the intermediate heat-treatment, for which the temperature and gas atmosphere can be freely selected, the grate can then be pushed on by an additional cross-pusher means through the open intermediate door and into the final treatment chamber 16.

A final treatment chamber 16 is followed, via a gas-tight outlet door, by an oil or salt quenching bath 31, followed by a discharge lock, from where the workpiece charges can be withdrawn after they have left the hardening bath.

Connected to the intermediate transfer lock 19 is another vacuum entry lock 24 through which the individual workpiece charges can be fed directly into the intermediate treatment chamber 15, via the intermediate transfer lock 19, for repair purposes or for exclusive hardening, without having to pass the first furnace unit 12.

The individual workpiece charges are transferred by means of a charging carriage 39 via a transfer section 43 to a connection channel 25 from where they can be transferred, via a cross-pusher drive, into the first vacuum lock 23 or a second vacuum lock 24.

A workpiece loading/unloading elevation platform 42 is provided, by means of which the individual workpiece charges can be stored in a storage section 41 and transferred from the latter into the charging car 39. By means of the charging car 39, the workpiece charges can be transported to other components of the system, to low-temperature cells **37*a*, 37*b*, to a washing system 36 or to a large-surface storage 40**, for intermediate storage.

Figure 2:
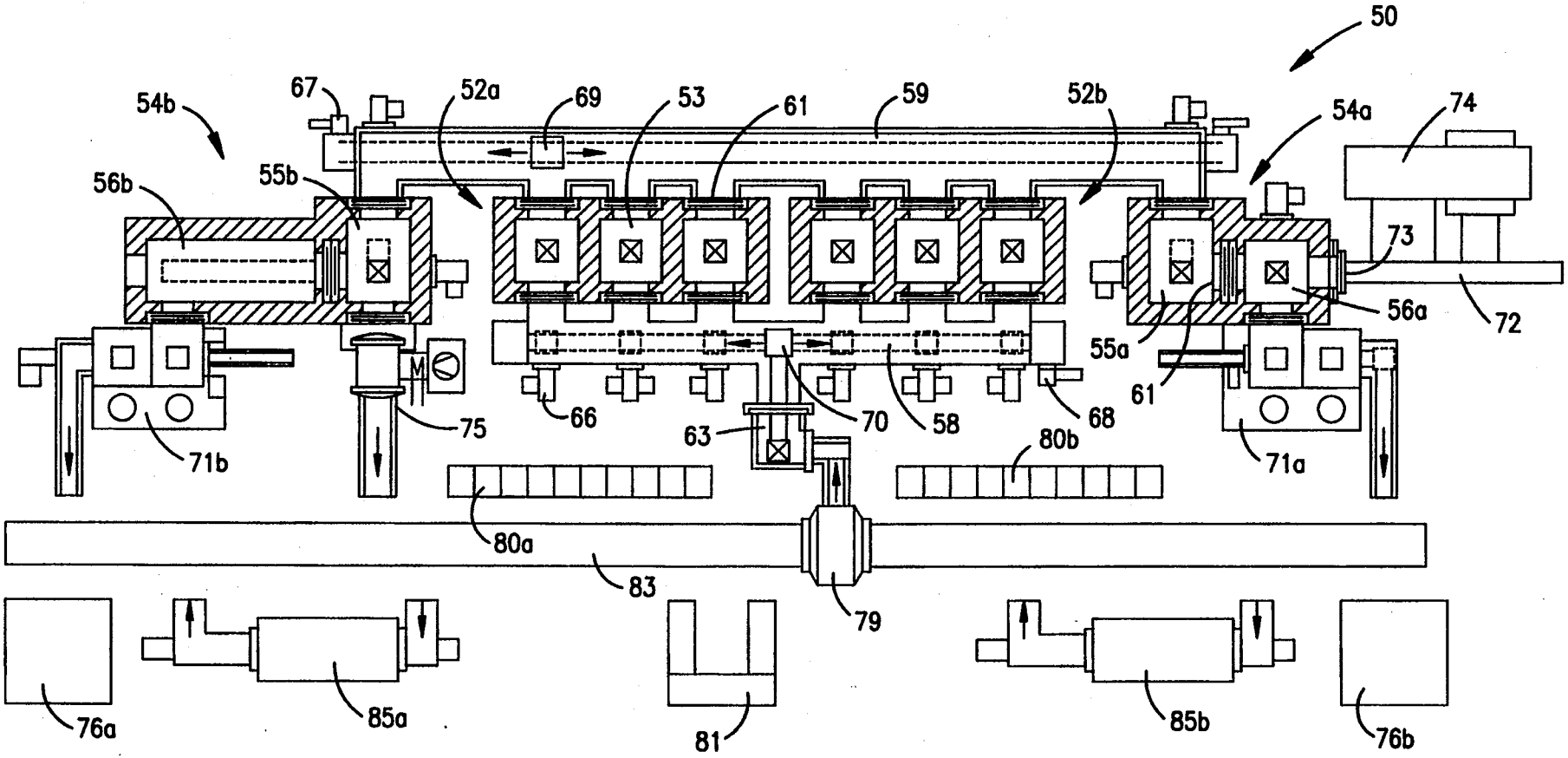
FIG. 2 shows a diagrammatic representation of a second embodiment of the invention.

Another embodiment of the invention is indicated generally by reference numeral 50 in FIG. 2.

In this case, two furnace units **52*a*, 52*b* are provided for high-temperature treatment, each being subdivided in three identical individual chambers 53 that can be closed by gas-tight inlet and outlet doors 61. The temperature, gas atmosphere and dwelling time of the workpiece charges can be freely configured for each individual chamber 53**.

For charging the six individual chambers 53, there is again provided, in the manner described before in connection with FIG. 1, an entry transfer lock 58 to which individual grates with workpiece charges can be fed via a vacuum entry lock 63. A grate transport car 70 provided in the entry transfer lock 58 can be freely positioned relative to the outlet of the vacuum entry lock 63 or relative to the inlet doors 61 of the individual chambers 53, by means of a gas-tight continuous drag-chain drive 68. For transporting the grates between the individual components of the system, i.e. for example for pushing a grate into, and later out of, an individual chamber 53, cross-pusher means 66 are provided here, too.

For the subsequent treatment of the workpiece charges, two additional furnace units **54*a*, 54*b* are provided comprising each an intermediate treatment chamber 55*a* and 55*b*, respectively, and a final treatment chamber 56*a* and 56*b*, respectively. Here again, the individual chambers can be closed by gas-tight doors 61**, and the heat-treatment parameters temperature, dwelling time and gas atmosphere can be freely selected.

The intermediate treatment chambers **55*a* and 55*b* communicate with an intermediate transfer lock 59 via gas-tight inlet doors. The unheated intermediate transfer lock 59 is again provided with an inner insulation as protection against radiation, and is gas-tight in order to permit the application of a protective gas. For transferring the grates between the individual chambers 53 and the intermediate treatment chambers 55*a* and 55*b*, respectively, a grate transport car 69 is provided which can be displaced in a controlled way by means of a gas-tight continuous drag-chain drive 67 with servomotor and positioning control in order to enable the grate to be pushed out of an individual chamber 53 into the intermediate transfer lock 59, or to be pushed into one of the two intermediate treatment chambers 55*a*, 55*b*. The entry transfer lock 58 and the intermediate transfer lock 59** are exposed in full to the admitted protective gas.

The final treatment chamber **56*a* of the next following furnace unit 54*a* is connected, via a slotted sliding door, with a single-item unloading device 72 by means of which delicate workpieces can be transferred to a hardening press 74 with re-cooling means for distortion-free hardening. The first final treatment chamber 56*a* is further connected, via a gas-tight door, with a quenching bath 71*a***, for quenching the workpieces in an oil or salt bath, followed by a discharge lock.

The second intermediate treatment chamber **55*b* is equipped with a gas-tight outlet door through which workpiece charges can be transferred to a high-pressure gas quenching system 75. Alternatively, the workpiece charges can pass from the second intermediate treatment chamber 55*b* via a gas-tight intermediate door to the final treatment chamber 56*a* which again communicates via a gas-tight outlet door with a quenching bath 71*b*** for oil or salt, followed by a discharge lock.

Figure 3:
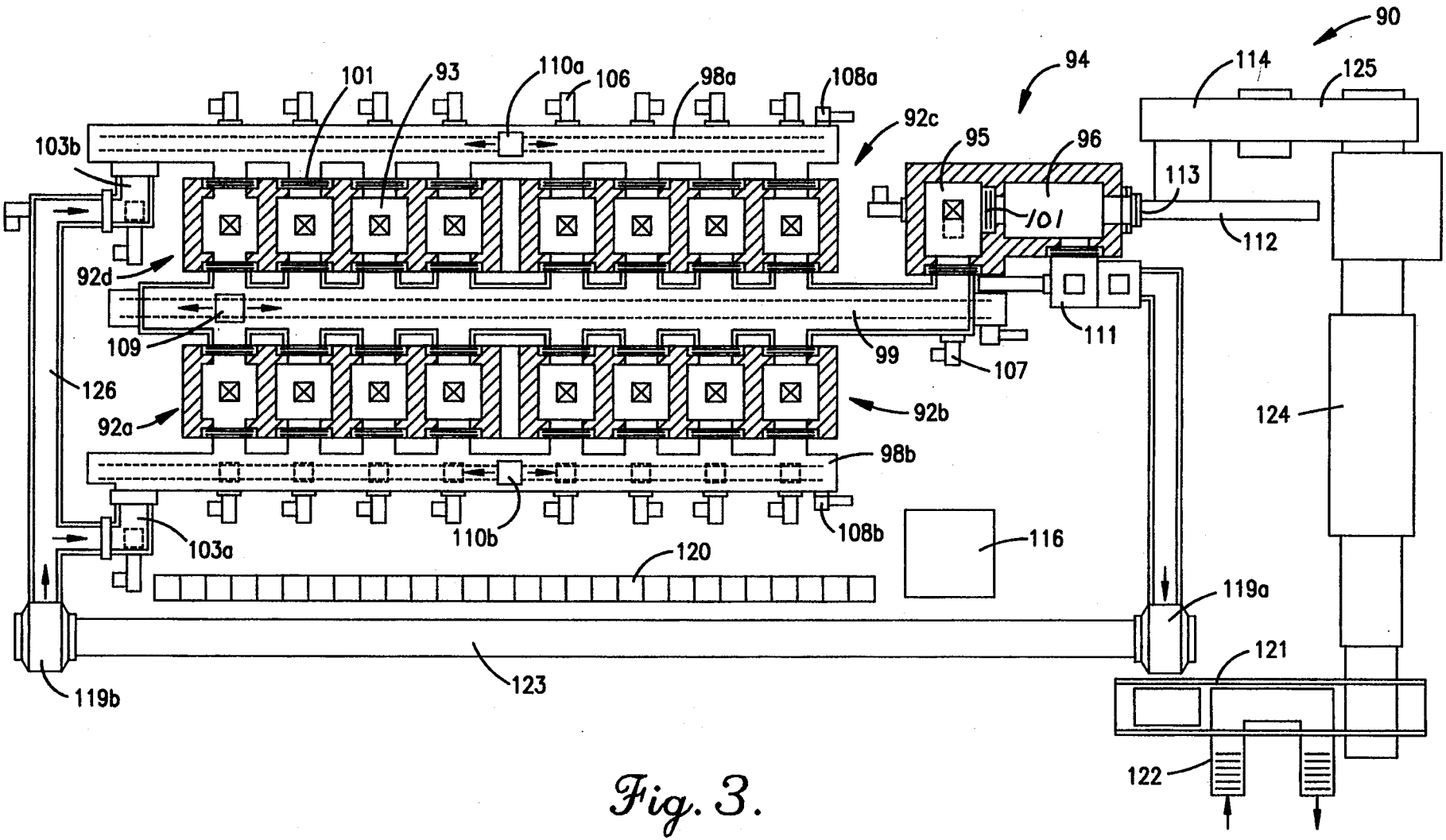
FIG. 3 shows a diagrammatic representation of a third embodiment of the invention.

For loading and unloading individual workpiece charges, there is again provided a charging car 79 that can be moved along a transfer section to the individual components and/or their connection lines. The charging car 79 can be used also for transporting workpieces to other components of the plant, such as large-surface stores **80*a*, 80*b*, annealing furnaces with cooling section 85*a*, 85*b*, washing systems 76*a*, 76*b* and a loading/unloading elevation platform 81. Another embodiment of the invention is indicated generally by reference numeral 90 in FIG. 3**.

There can be seen a total of four identically designed furnace units **92*a*, 92*b*, 92*c*, 92*d* each of which is subdivided into four equal individual chambers 93 that can be closed by inlet doors and outlet doors 101. The heat-treatment parameters temperature, dwelling time and gas atmosphere can be individually controlled for each of the individual chambers 93**.

of each of the furnace units **92*a*, 92*b* and 92*c*, 92*d*, respectively, two units arranged on both sides of an intermediate transfer lock 99 so that a total of eight individual chambers 93 are provided in opposite arrangement on both sides of the intermediate transfer lock 99**.

Entry transfer locks 98b and 98a, respectively, are provided for charging every two of the furnace units 92a, 92b and 92c, 92d, respectively.

Feeding grates with workpiece charges into the entry transfer locks 98a, 98b, respectively, is effected via a vacuum entry lock 103a and 103b, respectively. The entry transfer locks 98a, 98b and the intermediate transfer lock 99 are of gas-tight design and supplied with a protective gas. The intermediate transfer lock 99 is unheated and provided with an inner insulation as protection against radiation. For transporting the grates within the entry transfer locks 98a, 98b, and the intermediate transfer lock 99, grate transport cars 110a, 110b and 109 are provided, each of which can be displaced and positioned within the entry transfer locks 98a, 98b, or within the intermediate transfer lock 99, by means of a gas-tight grate transport car drive 108a, 108b and 107, respectively.

For transporting the grates between the individual components of the plant, cross-pusher means 106 are provided here, too.

The intermediate transfer lock 99 is connected with a downstream furnace unit 94 comprising an intermediate treatment chamber 95 and a final treatment chamber 96 separated therefrom by a gas-tight door. From the intermediate transfer lock 99, the workpiece grates are pushed into the system by means of a cross-pusher means, after the gas-tight inlet door has been opened, and then, after completion of an intermediate treatment step, into the final treatment chamber 96 for execution of another heat-treatment step.

In both the intermediate treatment chamber 95 and the final treatment chamber 96, the heat-treatment parameters temperature, dwelling time and atmosphere can be controlled again separately for each workpiece charge.

From the final treatment chamber 96, the workpiece charges can be unloaded either by means of a single-item unloading device 112, via a slotted sliding door 113, for being transferred to a hardening press 114 with re-cooling system, or via a discharge gas-cooling lock 111 for pressureless cooling.

For further treatment of the workpiece charges, after they have left the re-cooling system upon completion of the hardening process, an after-treatment unit 124 is provided, which is equipped with a conveyor transport system comprising a washing unit, a drying unit, an annealing unit and a subsequent air cooling unit.

A transfer manipulator 125 with positioning control serves for handling the workpieces during their individual withdrawal, or for transferring them to the hardening press 114.

Another transfer manipulator 125 with positioning control is provided for handling the workpieces in the loading and unloading area 122.

For the purpose of feeding-in and/or withdrawing the workpieces, two loading cars 119a, 119b are provided, which can be displaced along a transfer section 123. Starting from the loading car 119b, the grates with the workpiece charges are transported through a connection channel 126 to the vacuum entry locks 103a, 103b respectively.

Other components of the plant, such as the large-surface storage 120 and another washing system 116, can be reached via the loading cars 119a and 119b, respectively.

I claim:

1. An apparatus for heat-treating metallic workpieces, comprising:

first furnace means having a plurality of individual chambers, each chamber being provided with a gas-tight inlet door, a gas-tight outlet door, and means for controlling temperature, dwell time and atmosphere individually for each of said chambers and for each workpiece charge within one of said chambers;

second furnace means arranged downstream said first furnace means, said second furnace means being provided with a gas-tight inlet door, a gas-tight outlet door, and means for controlling temperature, dwell time and atmosphere individually for each workpiece charge within said second furnace means;

a feeding device for feeding said workpieces charge-by-charge to said first furnace means, said feeding device being provided with low gas loss loading means being designed as a first vacuum inlet lock, and first gas-tight conveyor means being designed as an inlet transfer lock and being arranged between said loading means and said gas-tight inlet doors of said individual chambers for allowing direct random access loading of workpiece charges to said individual chambers;

second gas-tight conveyor means for transporting said workpiece charges after said individually set dwell time has lapsed from said first furnace means to said second furnace means, said second conveyor means being designed as intermediate transfer lock means having an input and an output, said input being connected to said gas-tight outlet doors of said individual chambers for allowing direct random access unloading of workpiece charges from said individual chambers, and said output being connected to said second furnace means.

2. The apparatus of claim 1, wherein a cross-pusher means for loading and unloading is arranged in front of each individual chamber.

3. The apparatus of claim 1, wherein said intermediate transfer lock is adapted to be connected with a second vacuum inlet lock.

4. The apparatus of claim 1, wherein said second furnace means comprises a plurality of individual chambers, each of which being provided with gas-tight doors and means for individually controlling temperature, dwell time and atmosphere within said chambers.

5. The apparatus of claim 4, wherein an intermediate treatment chamber is provided in said second furnace means and is adapted to be connected with a downstream final treatment chamber via a gas-tight door.

6. The apparatus of claim 5, wherein said final treatment chamber is adapted to be connected with a quenching bath with an outlet lock.

7. The apparatus of claim 4, wherein said second furnace means is adapted to be connected with an unloading device for unloading individual workpieces and comprising a hardening press and an after-cooling system for delicate workpieces.

8. The apparatus of claim 4, wherein said second furnace means is adapted to be connected to a high-pressure gas quenching system.

9. The apparatus of claim 8, wherein cooling gas from said high-pressure gas quenching system is fed to said intermediate transfer lock, to said inlet transfer lock and to said first vacuum entry lock.

10. The apparatus of claim 1, wherein said second furnace means is adapted to be connected with a gas cooling lock.

* * * * *

UNITED STATES PATENT AND TRADEMARK OFFICE

CERTIFICATE OF CORRECTION

PATENT NO. : 5,402,994

DATED : April 4, 1995

INVENTOR(S) : Helmut Egger

It is certified that error appears in the above-identified patent and that said Letters Patent is hereby corrected as shown below:

On the title page, the foreign application priority data should read:

— [22] PCT Filed: Jan. 15, 1992

[86] PCT No.: PCT/DE92/00019

[87] PCT Publ. No. WO93/14229

PCT Publ. Date: Jul. 22, 1993 —

Signed and Sealed this

Fifth Day of December, 1995

*Attest:*

*Attesting Officer*

Bruce Lehman

BRUCE LEHMAN

*Commissioner of Patents and Trademarks*